US007278415B2

(12) United States Patent
Jones

(10) Patent No.: US 7,278,415 B2
(45) Date of Patent: Oct. 9, 2007

(54) ARCHERY BOWSTRING RELEASE WRIST STRAP ASSEMBLY

(75) Inventor: Brian K. Jones, Clay City, KY (US)

(73) Assignee: Scott Archery Manufacturing, Clay City, KY (US)

( * ) Notice: Subject to any disclaimer, the term of this patent is extended or adjusted under 35 U.S.C. 154(b) by 0 days.

(21) Appl. No.: 10/636,345

(22) Filed: Aug. 7, 2003

(65) Prior Publication Data

US 2004/0074482 A1 Apr. 22, 2004

Related U.S. Application Data

(63) Continuation-in-part of application No. 10/171,282, filed on Jun. 13, 2002, now abandoned.

(51) Int. Cl.
*F41B 5/18* (2006.01)

(52) U.S. Cl. ..... 124/35.2; 124/35.2

(58) Field of Classification Search ..... 124/35.2; 224/267

See application file for complete search history.

(56) References Cited

U.S. PATENT DOCUMENTS 4,041,926 A * 8/1977 Troncoso et al. ..... 124/35.2
4,426,989 A 1/1984 Sutton
4,831,997 A 5/1989 Greene
5,261,581 A 11/1993 Harden
5,307,966 A * 5/1994 Inaba et al. ..... 224/578
5,653,214 A 8/1997 Lynn ..... 124/35.2
5,937,841 A 8/1999 Summers et al. ..... 124/35.2
6,481,431 B1 11/2002 Summers ..... 124/35.2

* cited by examiner

*Primary Examiner*—John A. Ricci
(74) *Attorney, Agent, or Firm*—Warner Norcross & Judd LLP

(57) ABSTRACT

An archery bowstring release assembly is provided with a flexible and infinitely adjustable connection between the bowstring release and the pull ring. A ring with a slot through the solid portion is attached to a wrist strap. The slot is threaded with a web material or cord; both ends are passed either through or against the ring and either clamped together or clamped against the ring. The clamp is positioned on the loop of material or cord so that the loop may be shortened or lengthened to adjust the distance from the wrist strap to the release.

24 Claims, 4 Drawing Sheets

ARCHERY BOWSTRING RELEASE WRIST STRAP ASSEMBLY

CONTINUATION-IN-PART APPLICATION

This application is a Continuation-in-Part Application claiming priority from application Ser. No. 10/171,282, filed Jun. 13, 2002, now abandoned for all common material therein.

FIELD OF THE INVENTION

This invention relates to archery bowstring release and wrist strap assemblies and, more specifically, to the manner in which the archery bowstring release is connected to the wrist strap to afford infinite adjustability within a define range of positions of the archery bowstring release relative to the wrist strap while maintaining a stable and consistent location for the bowstring release/wrist strap interconnection.

BACKGROUND OF THE INVENTION

Archers use a bowstring release assembly to draw and/or release a bowstring in order to provide conditions as consistent as possible for each release of the bowstring. Use of a bowstring release eliminates some of the variability inherent in the manual release of a drawn bowstring.

The bowstring release assembly is attached to a wrist strap which is, in turn, worn on and wrapped around an archer's wrist. Locating the assembly in this position further eliminates at least some of the variables in the release of the bowstring with the archer's fingers by requiring less movement of the fingers to effect release of the bowstring.

To operate a bowstring release, a single finger engages and gently pulls the trigger of the release device thereby unlatching a restraining member which engages the bowstring, permitting the drawn bowstring to be pulled toward the bow and project the arrow toward its target.

All persons vary in several physical aspects that affect the reliable use of a bowstring release, such as hand size, wrist size, arm length and other physical variables. These enumerated variables are accommodated by adjustability of the archer bowstring release wrist strap.

Prior art releases have used various incremental adjustability schemes and, in many instances, the adjustability of the distance between the wrist strap and the bowstring release mechanism is a rigid connection. The rigid connection both inhibits the bowstring release from being positioned away from the palm of the archer's hand and prevents unencumbered use of the hand for other purposes.

OBJECTS OF THE INVENTION

It is an object of the invention to provide an improved archery bowstring release assembly.

It is another object of the invention to provide a flexible connection between a release and a wrist strap.

It is a further object of the invention to provide an infinitely adjustable connection between a wrist strap and an archery bowstring release.

It is an additional object of the invention to improve the functionality of the archer's hand while wearing this archery bowstring release and wrist strap.

It is a still further object of the invention to confine the connection of the wrist strap and the archery bowstring release to a restricted location on the wrist strip while ensuring the flexibility and adjustability of the archery bowstring release relative to the wrist strap.

These Objects of the Invention are set forth at this point for the purpose of identifying some of the objects and characteristics of the invention; however, these objects or others that are not enumerated are not intended to be used to limit the invention in any manner.

BRIEF SUMMARY OF THE INVENTION

The pull ring is attached to the outer surface of an archery wrist strap. The pull ring, having a pair of segments of the circumscribing outer portion against which forces are exerted by a wrist strap, is disposed with a pair of the segments substantially transverse to the legs of a wrist strap which is formed in a substantially right angular form. Attachment is preferably accomplished by use of a web of heavy fabric, such as a nylon web or strap or a piece of leather, folded and engaged at the fold, with the transverse portions of the pull ring and the web or strap sewn or otherwise permanently attached to the outer surface of the wrist strap.

The pull ring is formed in a generally square or pentagonal shape with a central aperture but may be of a triangular shape with a large central hole or a pair of holes parallel to the segments of the periphery engaged by the web or leather attaching straps. At least a portion of the walls of the central aperture parallels the transverse portions of the ring to form the retaining and stabilizing pair of portions of the circumscribing outer portions.

Alternatively, the retaining and stabilizing portions of the pull ring may be made by forming a pair of slots with an elongated wall of each slot and the transverse portions of the ring cooperating to form the retaining and stabilizing pair of portions of the pull ring.

The pull ring is further formed to define a loop slot for acceptance of a loop of a third web or cord. The third web or cord is a length of flexible material such as nylon webbing or nylon cord formed into a loop and threaded through the slot or aperture in the bowstring release mechanism; both of the end portions of the web are clamped with a clamp which is tightened in order to hold without slipping the end portions of the web or cord. The clamp is then pulled against but not through the pull ring.

The bowstring release assembly may include a loop of heavy cord or web and the clamp may be attached to and tightened to the pull ring to retain the cord or web.

The web or cord loop permits the bowstring release to be moved out of the way so that the user may use his hand without either having to deal with a rigid structure or having to remove the wrist strap.

The length of the web loop or cord loop either formed by the clamp or the clamp and the pull ring may be infinitely varied to adjust the distance between the bowstring release mechanism and the ends of the looping web or cord loop to accommodate size variances in hands and wrists or length of arms.

This Summary of the Invention is very brief. Reference should be made to the Detailed Description of the Invention below for a more detailed understanding of the invention.

The Summary of the Invention is not intended to nor should it be used for limiting the invention in any manner.

DETAILED DESCRIPTION OF THE BEST MODE OF THE PREFERRED EMBODIMENT OF THE INVENTION AS CONTEMPLATED BY THE INVENTOR

Figure 1:
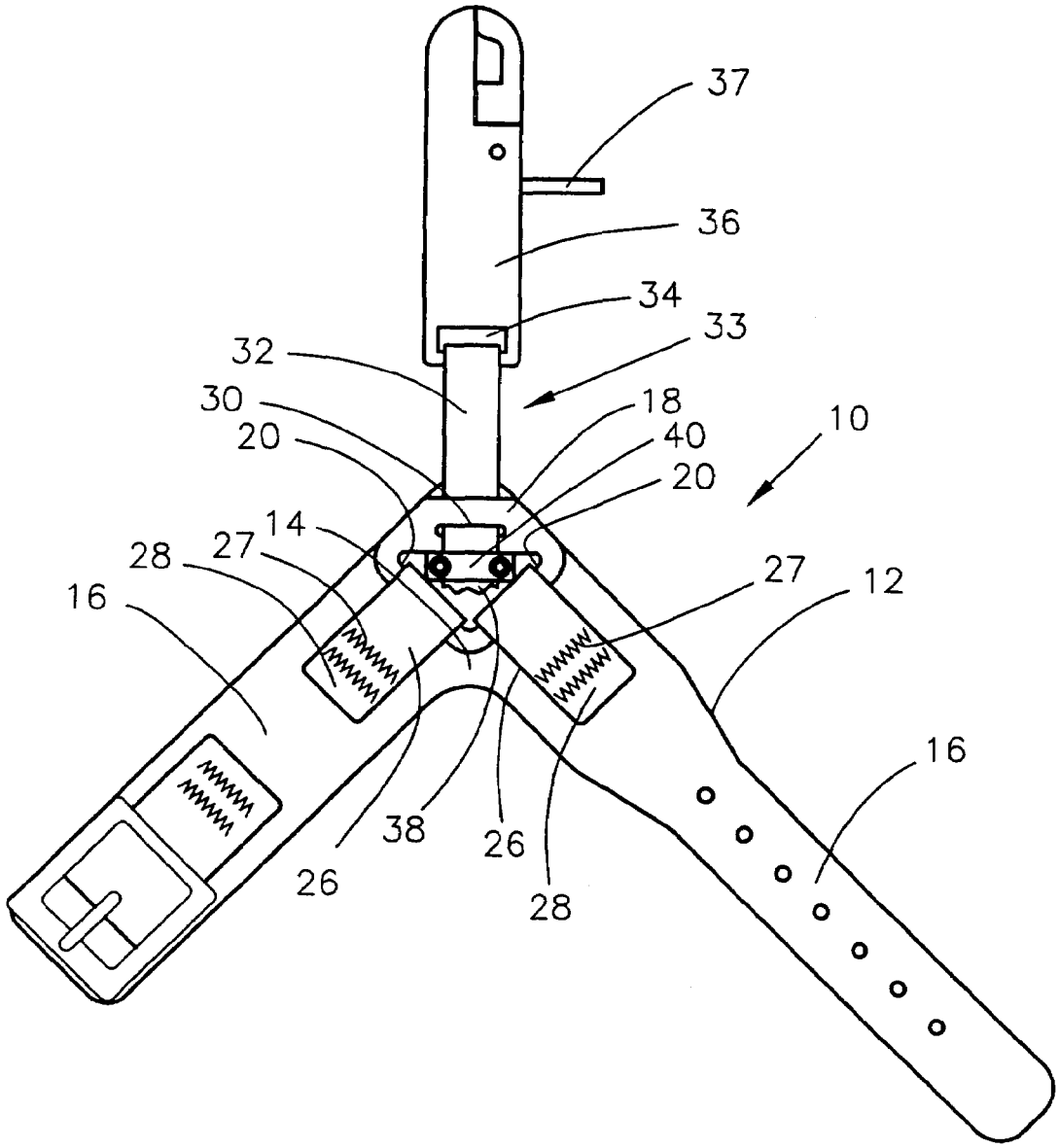
FIG. 1 illustrates an archery bowstring release assembly incorporating the invention and having a buckle fastening arrangement.

Referring initially to the drawings and particularly to FIG. 1, an archery bowstring release assembly 10 is shown.

The bowstring release assembly 10 is used to draw, hold and release the bowstring of a bow for archery target shooting and hunting.

The release assembly 10 includes a wrist strap 12 which is typically arranged about the wrist of the user. The apex 14 of the strap 12 is formed by a pair of legs 16 which intersect intermediate the ends of strap. When worn, the apex 14 is disposed proximate the palm of the user's hand and the legs 16 of the strap 12 are wrapped around and across the back of the user's wrist and fastened together to form a wrist-confining loop 17, as in FIG. 2.

The wrist strap 12 supports a pull ring 18 which is attached thereto. The pull ring 18 is illustrated in various forms in FIGS. 1, 2, 3 and 4. The pull ring 18 is typically fashioned to provide a pair of strap-engaging surface edges 20. The surface edges 20 are formed by either a central aperture 22 (FIG. 3) or by a pair of slots 24, as illustrated in FIG. 4.

The angle between the surface edges 20 is complementary to the angle formed by the legs 16 of strap 12. In the embodiments illustrated, the angle formed by legs 16 of strap 12 herein is approximately a right angle, but may vary as desired by the fabricator of the strap 12, resulting in the angle between the surface edges 20 being also approximately a right angle.

Figure 2:
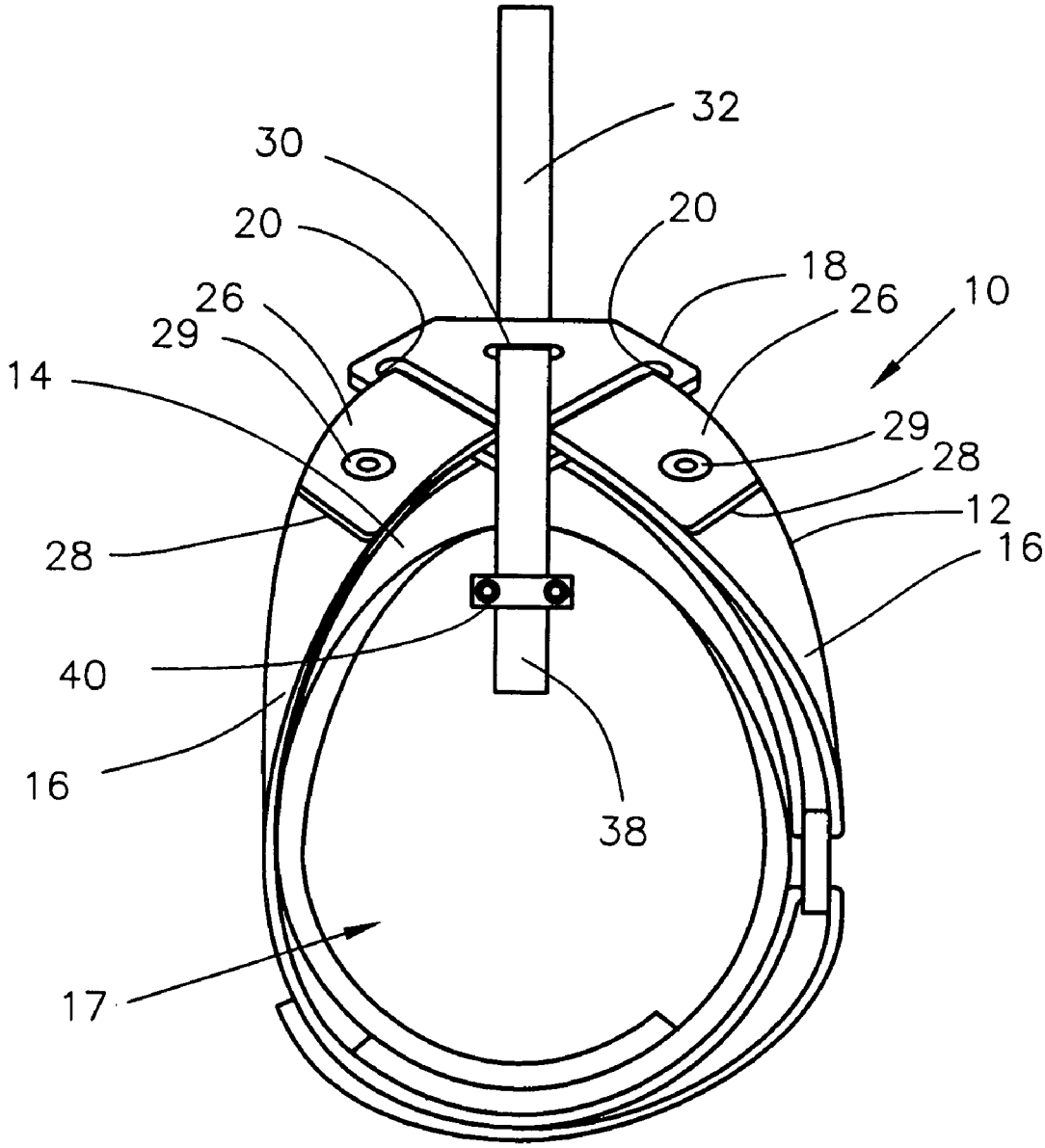
FIG. 2 illustrates an archery bowstring release assembly incorporating the invention and having a hook and loop fastening arrangement.
Figure 3:
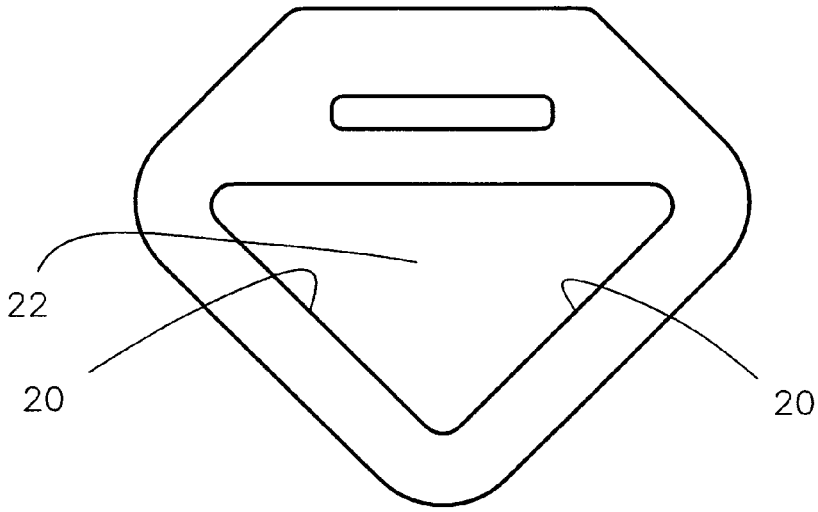
FIG. 3 illustrates an embodiment of the pull ring suitable for use in either of the archery bowstring release assemblies illustrated in FIGS. 1 and 2.
Figure 4:
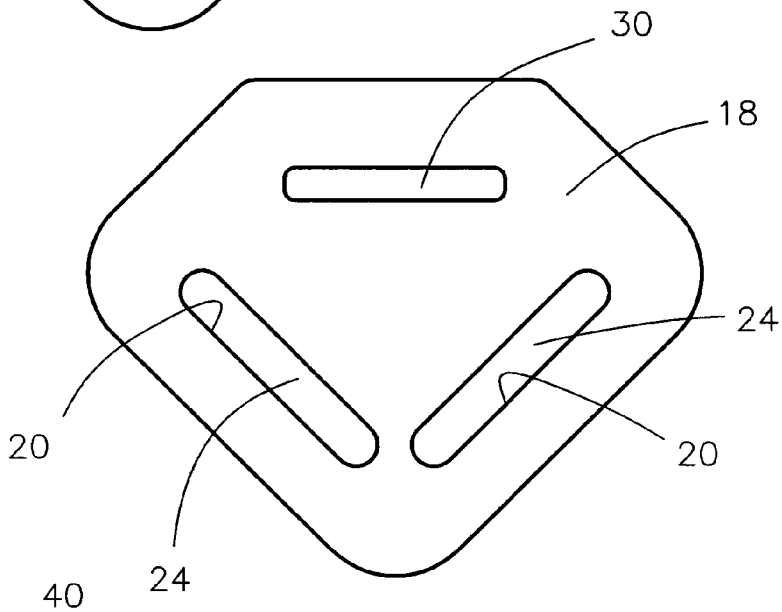
FIG. 4 illustrates another embodiment of the pull ring suitable for use in either of the archery bowstring release assemblies illustrated in FIGS. 1 and 2.

The pull ring 18 illustrated in FIGS. 3 and 4 is attached to the strap 12 by threading a short length of a flexible strap 26 (FIGS. 1 and 2) through slots 24 or central aperture 22 and doubling the web strap 26 and extending the web end portions 28 (FIGS. 1 and 2) web strap away from the pull ring 18. The web end portions 28 are affixed by stitching 27 (FIG. 1) or other fastening techniques such as riveting 29 (FIG. 2) or bonding. The web straps 26 may be made from a sturdy and stable material such as leather or Nylon webbing.

Pull ring 18 is disposed so that its surface edges 20 (FIGS. 3 and 4) extend transverse to legs 16, approximately perpendicular. This orientation of a pull ring 18 relative to the wrist strap 12 disposes slot 30 of ring 18 for acceptance of a strap 32 or web 32 therethrough. Thus oriented, the strap 32 approximately bisects the angles formed by the surface edges 20 and the angle of the legs 16 of strap 12.

Web 32 is folded or doubled to form a loop, and one end portion 38 of the web 32 is threaded through an opening 34 in the body of the bowstring release mechanism 36. The web 32 is then folded back on itself and the end portions 38 of the web 32 are threaded through slot 30 of pull ring 18.

Clamp 40 engages both end portions 38 of the loop 32 and is used both to fix the web loop 32 in slot 30 and prevent web loop 32 from being removed from the slot 30.

The clamp 40 must be very compact in order to not interfere with the use of the bowstring release assembly 10. At the same time, the clamp 40 must be strong enough to hold the end portions 38 of web 32 against slippage relative to the clamp 40 and further must resist at least the forces exerted on the clamp 40 in order to draw and hold the bowstring of a bow (not shown).

Figure 5:
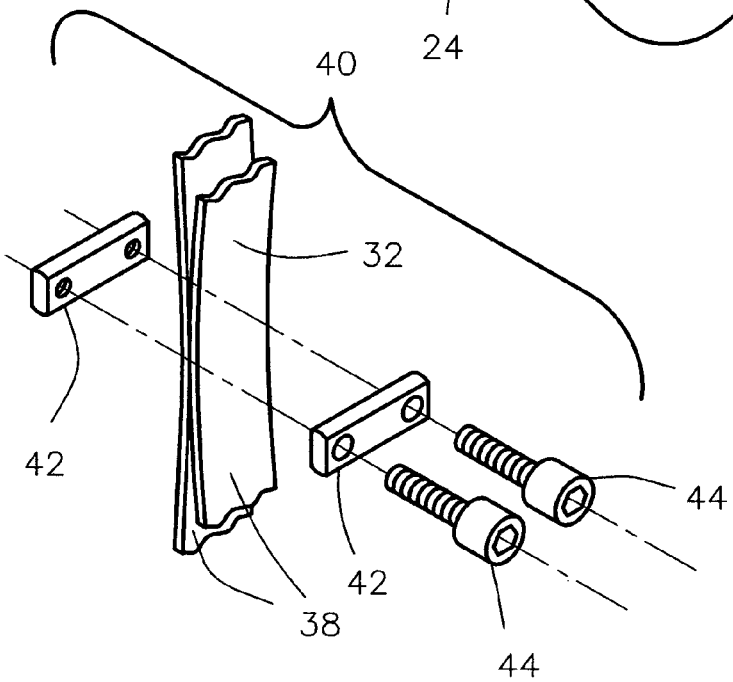
FIG. 5 illustrates a clamp of the type suitable for engaging and clamping the web loop of the archery bowstring assemblies in FIGS. 1 and 2.

The clamp 40, illustrated in detail in FIG. 5, is comprised of a pair of bars 42, which act as jaws. The bars 42 are drilled and/or tapped to accept cap screws 44 or other similar fasteners.

The web 32 is infinitely adjustable between limits defined by the length dimension of the web 32 permitting the pull point of engagement with the release 36 and the clamping point to be varied so that any wear may be overcome, even in the field. Only a common Allen wrench to manipulate the cap screws 44 is required. By adjusting the position of the clamp 40, the index finger will occupy a position such that operation of the trigger 37 may be accomplished smoothly and without concentration of the user.

The use of the pull ring 18 and the clamp 40 to retain the web 32 provides infinite or micro-adjustability of the length of the loop of web 32 while providing the flexibility necessary to fold the bowstring release 36 out of the way whenever not drawing the bowstring.

Further, the clamp 40 and the pull ring 18 with its web-accommodating slot 30 provide a non-damaging surface against which the web 32 is positioned to reduce wear and tear to the web 32.

Preventive maintenance for the archery bowstring release assembly 10 is made easy. The web 32 and clamp 40 may be removed and a new web 32 inserted and reclamped, using the original clamp 40, thus assuring continued utility and reliability of the bowstring release assembly 10.

This Detailed Description of the Invention is made with reference to drawing illustrations of and descriptions of a release mechanism manufactured by and available from Scott Archery Manufacturing, Inc. of Clay City, Ky., the Assignee of this invention. The illustration of this type of release is a matter of choice inasmuch as any suitable release, i.e., jaw type, or cord type, may be attached to the web 32 or modified to provide a slot such as slot 34 for each attachment.

Figure 6:
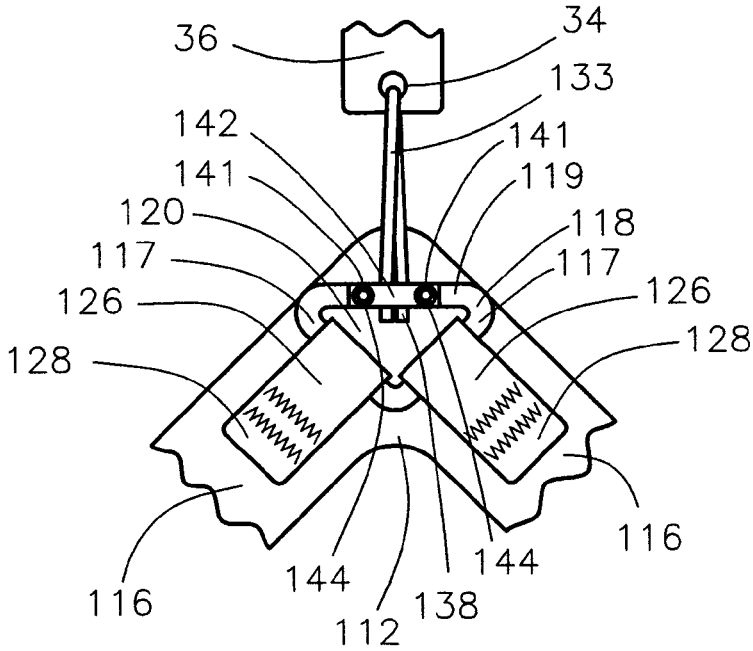
FIG. 6 illustrates an alternative clamping arrangement using a single clamp bar and the pull ring to clamp a web of the archery bowstring assembly.
Figure 7:
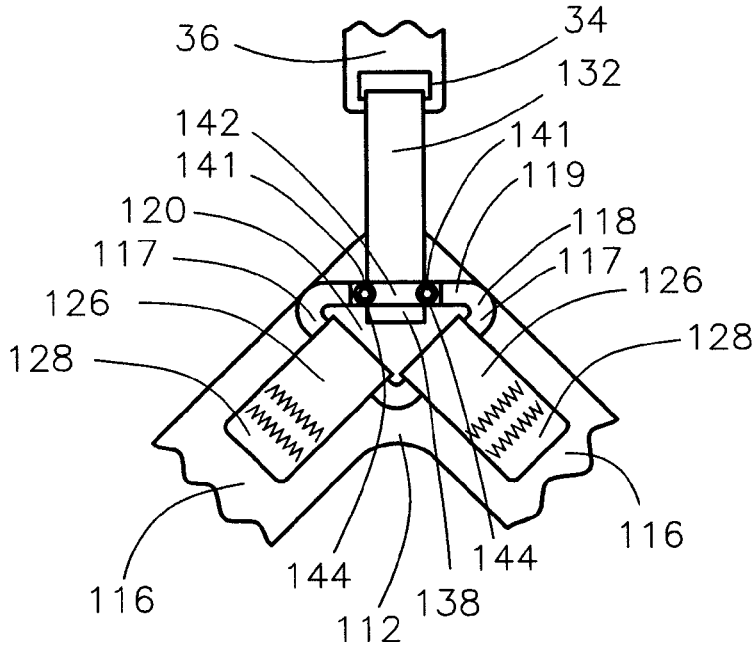
FIG. 7 illustrates an alternative clamping arrangement using a single clamp bar and the pull ring to clamp a cord of the archery bowstring assembly.

An alternative embodiment of this invention is disclosed in FIGS. 6 and 7. The web strap 26 of the primary embodiment shown in FIGS. 1 and 2 is replaced by a cord 133. The cord 133 is functionally the equivalent to the web strap 26 in transferring the pull of the wrist strap 12 to the body 36 of the bowstring release 10.

A pull ring 118 is formed with a central opening 120 to provide a means for the passage of the straps 126 through the pull ring 118 prior to the attachment of the end portions 128 of the straps 126 to the wrist strap 112.

The central opening 120 of the pull ring 118 may be replaced by a pair of slots 24 (not shown in FIG. 7) formed into the ring 118 to form passages for the straps 126, prior to the attachment of the straps 126 to the wrist strap 112.

The portion 119 of the pull ring 118 extending between the strap engaged portions 117 is oriented to be perpendicular to the bisector of the angle between the legs 116 of the wrist strap 112. The portion 119 of the ring 118 so positioned is provided with a pair of holes 141 to accept screws 144 extending through a clamping bar 142 and threading into the holes 141 of the pull ring 118.

The web 132 of the embodiment described in relation to FIG. 7 may be interchanged with cord 133 of FIG. 6. The loops of web 132 and cord 133 shown in FIGS. 6 and 7 are interchangeable and may be positioned with the end portions 138 of the web 132 or cord 133 disposed adjacent one another and laid over the pull ring 118 and between the threaded holes provided therein with the same spacing as the holes 141 of pull ring 118.

A clamp bar 142 of suitable length to cover the web 132 or cord 133 is placed over the end portions 138 of the web 132 or cord 133 and the screws 144 tightened to clamp the web 132 or cord 133 between clamp bar 142 and the pull ring 118. Sufficient tightening of the screws 144 to hold the web 132 or cord 133 against movement relative to the clamp bar 142 and pull ring segment 119 should be accomplished.

With the cord 133 threaded through the opening 34 in the body of the release 36, the cord 133 acts as a force transmission member, similar to the web 32 of the embodiment shown in FIGS. 1 and 2.

The types of wrist straps illustrated herein are made and sold by Scott Archery Manufacturing, Inc. of Clay City, Ky. The selection of these style wrist straps was a matter of choice only and to illustrate the invention as used with various style wrist straps. Various other styles and makes of wrist straps are available to the public and most wrist straps available to the public may be used or modified in accord with the teachings of this disclosure to support and mount the pull ring. Therefore, the terms "bowstring release," "release" or "wrist strap" are intended to be inclusive and therefore are to be interpreted broadly and are not to be considered a basis for limiting the invention in any manner.

With a detailed understanding of the invention, it will be apparent to the artisan of ordinary skill in the art that minor changes and modifications may be made in the disclosed bowstring release assembly without removing the changed device from the protection afforded by the appended claims.

What is claimed is:

1. An archery bowstring release assembly comprising:

a bowstring release device comprising a release device and a release trigger;

said release device having at least one relatively movable member, said movable member engageable with a bowstring;

said release device comprising a body, said body supporting a trigger displaceable to initiate release of said bowstring, said body defining an aperture;

a wrist engageable strap formed to encircle a wrist of a user;

a rigid member attached to a surface of said wrist engageable strap;

a force transmission member having two end portions; and a clamp engaging both end portions of said force transmission member, said clamp being selectively adjustable to a clamped mode wherein said clamp is fixedly secured to and fixedly immovable relative to the rigid member, wherein said clamp clamps said end portions within said clamp so that the end portions are fixedly immovable relative to the clamp in said clamped mode and wherein the clamp fixes the distance between said clamp and said release device in said clamped mode, said clamp also adjustable to an adjustment mode wherein the clamp releases the end portions so that the distance between said rigid member and said release device is infinitely adjustable to accommodate varying hand sizes of individual users.

2. An archery bowstring release assembly comprising:

a bowstring release device comprising a release device and a release trigger;

said release device having at least one relatively movable member, said movable member engageable with a bowstring;

said release device comprising a body, said body supporting a trigger displaceable to initiate release of said bowstring;

said body defining an aperture;

a wrist engageable strap formed to encircle a wrist of a user;

a ring defining a slot, said ring attached to a surface of said wrist engageable strap;

a web having two end portions, both of said end portions extending through said slot; and a clamp engaging both end portions of said web, thereby preventing slippage of said web relative to said slot and said ring, said clamp being movable to adjust the distance between said clamp and said release device, whereby a distance between said ring and said release device is infinitely adjustable to accommodate varying hand sizes of individual users;

wherein said ring further forms an enlarged opening therein.

3. The archery bowstring release assembly of claim 2 wherein said wrist engaging strap further comprises a pair of extending legs of strap material, said legs intersecting at an angle and said ring disposed at and attached to said wrist band strap proximate to an apex of said angle.

4. The archery bowstring release assembly of claim 3 wherein said ring is attached to said wrist band strap by a pair of attaching webs extending through said enlarged opening in said ring and attached to said legs of said strap.

5. The archery bowstring release assembly of claim 4 wherein said clamp comprises a pair of bars disposed transverse to said web end portions and at least a fastening member engaging said bars to force said bars onto said web end portions.

6. The archery bowstring release assembly of claim 5 wherein each of said pair of bars are sized to prevent passage through said slot.

7. The archery bowstring release assembly of claim 5 wherein said pair of bars collectively are sized to prevent passage of said bars through said slot.

8. An archery bowstring release assembly comprising:

an archery bowstring release device;

a wrist engaging member that encircles a user's wrist;

a flexible member retainingly engaged with said release device;

said flexible member comprising two end portions, each of said end portions comprising an end;

a ring joined with a surface of the wrist engaging member; and a clamp element joined with the ring, wherein said end portions are positioned between said clamping element and said ring, said clamping element engaged to a clamped mode wherein said clamping element is fixedly immovable relative to said ring, and wherein said clamping element clamps said end portions between said clamp elements and said ring so that said clamped end portions are immovable relative to said ring and said clamping element, said clamping element adjustable to an adjustment mode to release said end portions so that the flexible member is infinitely adjustable over a range of length of said web end portions.

9. An archery bowstring release assembly comprising:

a means for releasing an archery bowstring;

a wrist engaging means for encircling a user's wrist;

a connecting means comprising a web of flexible material retainingly engaged with said means for releasing, a means for clampingly engaging said web of flexible material, and a ring means forming a slot aperture for connecting said web to said wrist engaging means;

said web comprising two end portions, each of said end portions comprising an end;

said end portions extending through said slot aperture in said ring means, said means for clamping engaged with said web end portions and said ring means for resisting the removal of said web end portions from said slot aperture;

said means for clamping engageable with said web at any location on said web between said end portions and said slot aperture thereby making said connecting means infinitely adjustable over a range of length of said web end portions;

wherein said means for clamping comprises a pair of jaw members and retaining means for forcing said jaw members against said web.

10. The archery bowstring release assembly of claim 9 wherein said jaw members are dimensioned to prevent passage of said jaw members through said slot aperture.

11. The archery bowstring release assembly of claim 9 wherein said jaw members are disposed on said web end portions and interconnected by a pair of screws to pull said jaws toward opposing sides of said web end portions.

12. The archery bowstring release assembly of claim 11 wherein said ring means is permanently attached to said wrist engaging means intermediate said ends of said wrist engaging means.

13. The archery bowstring release assembly of claim 12 wherein said ring means is attached by a pair of straps which pass through said ring means and is permanently attached to said wrist engaging means.

14. The archery bowstring release assembly of claim 13 wherein said straps are attached by stitches to said wrist engaging means.

15. The archery bowstring release assembly of claim 12 wherein said wrist engaging means comprises a flexible member having a pair of intersecting leg portions, said leg portions forming an angle and said ring means is disposed proximate said angle formed by said leg portions.

16. An archery bowstring release assembly comprising:

a bowstring release device comprising a release mechanism and a release trigger;

said release mechanism having at least one relatively movable member, said movable member engageable with a bowstring;

said release mechanism comprising a body, said body supporting a trigger displaceable to initiate release of said bowstring;

said body comprising an aperture in a portion of said body;

a wrist engageable strap formed to encircle a wrist of a user;

a rigid member comprising at least two openings to accept at least two screw threaded members;

said rigid member attached to a surface of said wrist engageable strap;

a force transmission member having at least a pair of end portions extending through said release body aperture and with said end portions extending to said rigid member; and a clamp retained by at least two screw threaded members clampingly engaging both end portions of said force transmission member between said clamp and said member, thereby preventing extension of said force transmission member, whereby a distance between said clamp and said release mechanism is infinitely adjustable to accommodate various sizes of hands of individual users.

17. The archery bowstring release assembly of claim 16 wherein said force transmission member is a woven web.

18. The archery bowstring release assembly of claim 17 wherein said member attached to a surface of said wrist engageable strap further forms an enlarged opening therein.

19. The archery bowstring release assembly of claim 18 wherein said wrist engaging strap further comprises a pair of extending legs of strap material, said legs intersecting at an angle and said member disposes and attached to said wrist engaging strap proximate to an apex of said angle.

20. The archery bowstring release assembly of claim 17 wherein said wrist engaging strap further comprises a pair of extending legs of strap material, said legs intersecting at an angle and said member disposed on and attached to said wrist engaging strap proximate to an apex of said angle.

21. The archery bowstring release assembly of claim 20 wherein said member is attached to said wrist strap by a pair of attaching webs extending through at least one opening in said member and attached to said wrist strap.

22. The archery bowstring release assembly of claim 20 wherein said member is attached to said wrist strap by a pair of attaching webs extending through at least one opening in said member and attached to said wrist strap.

23. The archery bowstring release assembly of claim 17 wherein said member attached to a surface of said wrist engageable strap further forms an enlarged opening therein.

24. The archery bowstring release assembly of claim 16 wherein said force transmission member is a length of cord.

* * * * *